US011165152B2

(12) United States Patent
Wang et al.

(10) Patent No.: US 11,165,152 B2
(45) Date of Patent: Nov. 2, 2021

(54) ANTENNA AND ELECTRONIC DEVICE

(71) Applicant: BEIJING XIAOMI MOBILE SOFTWARE CO., LTD., Beijing (CN)

(72) Inventors: Wei Wang, Beijing (CN); Wanbo Xie, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 16 days.

(21) Appl. No.: 16/689,038

(22) Filed: Nov. 19, 2019

(65) Prior Publication Data

US 2020/0388921 A1 Dec. 10, 2020

(30) Foreign Application Priority Data

Jun. 6, 2019 (CN) ..... 201910493480.2

(51) Int. Cl.

| | |
|---|---|
| ***H01Q 3/24*** | (2006.01) |
| ***H01Q 5/335*** | (2015.01) |
| ***H01Q 1/24*** | (2006.01) |
| ***H01Q 21/06*** | (2006.01) |

(52) U.S. Cl.
CPC ..... *H01Q 5/335* (2015.01); *H01Q 1/243* (2013.01); *H01Q 21/06* (2013.01)

(58) Field of Classification Search
CPC ..... H01Q 5/335; H01Q 1/243; H01Q 21/06; H01Q 21/12
USPC ..... 343/876
See application file for complete search history.

(56) References Cited

U.S. PATENT DOCUMENTS

| | | | | |
|---|---|---|---|---|
| 10,381,746 | B2 | 8/2019 | Zihir et al. | |
| 10,559,878 | B2 | 2/2020 | Rezvani | |
| 2015/0194736 | A1* | 7/2015 | Diukman | H01Q 21/0006 343/818 |
| 2017/0195004 | A1 | 7/2017 | Cheng et al. | |
| 2017/0353338 | A1 | 12/2017 | Amadjikpe et al. | |
| 2018/0034150 | A1 | 2/2018 | Rezvani | |
| 2018/0123229 | A1 | 5/2018 | Stratis et al. | |
| 2019/0089067 | A1 | 3/2019 | Zihir et al. | |

(Continued)

FOREIGN PATENT DOCUMENTS

| | | | |
|---|---|---|---|
| CN | 1572066 | A | 1/2005 |
| CN | 101212084 | A | 7/2008 |

(Continued)

OTHER PUBLICATIONS

First Office Action of the Russian application No. 2019139773, dated Jun. 15, 2020.

(Continued)

*Primary Examiner* — Peguy Jean Pierre
(74) *Attorney, Agent, or Firm* — Syncoda LLC; Feng Ma

(57) ABSTRACT

An antenna structure includes: an antenna array and a radio frequency component; and a radio frequency transfer switch, wherein the radio frequency transfer switch is connected with the antenna array and the radio frequency component, a number of the antenna array connected with the radio frequency transfer switch is greater than a number of the radio frequency component connected with the radio frequency transfer switch, the radio frequency transfer switch is configured to switch a feed object of at least one radio frequency component connected therewith, and the feed object is any antenna array connected therewith.

18 Claims, 5 Drawing Sheets

(56) References Cited

U.S. PATENT DOCUMENTS

| | | | |
|---|---|---|---|
| 2019/0089070 | A1 | 3/2019 | Zihir et al. |
| 2019/0089316 | A1 | 3/2019 | Zihir et al. |
| 2019/0089402 | A1 | 3/2019 | Zihir et al. |
| 2019/0115658 | A1 | 4/2019 | Iannotti et al. |
| 2019/0166523 | A1 | 5/2019 | Shaw et al. |
| 2019/0312360 | A1 | 10/2019 | Zihir et al. |
| 2019/0393599 | A1 | 12/2019 | Rezvani |
| 2020/0028562 | A1 | 1/2020 | Yang |
| 2020/0176865 | A1 | 6/2020 | Rezvani |

FOREIGN PATENT DOCUMENTS

| | | | |
|---|---|---|---|
| CN | 102646874 | A | 8/2012 |
| CN | 103439686 | A | 12/2013 |
| CN | 103856226 | A | 6/2014 |
| CN | 203982394 | U | 12/2014 |
| CN | 105098362 | A | 11/2015 |
| CN | 105390825 | A | 3/2016 |
| CN | 105870588 | A | 8/2016 |
| CN | 106332318 | A | 1/2017 |
| CN | 106410413 | A | 2/2017 |
| CN | 206040972 | U | 3/2017 |
| CN | 107394393 | A | 11/2017 |
| CN | 207766262 | U | 8/2018 |
| CN | 108493575 | A | 9/2018 |
| CN | 207992440 | U | 10/2018 |
| CN | 108988903 | A | 12/2018 |
| CN | 109004373 | A | 12/2018 |
| CN | 109216944 | A | 1/2019 |
| CN | 109524797 | A | 3/2019 |
| CN | 209948060 | U | 1/2020 |
| JP | H11-231040 | A | 8/1999 |
| JP | 2000258524 | A | 9/2000 |
| KR | 100842087 | B1 | 6/2008 |
| KR | 100924918 | B1 | 11/2009 |
| KR | 101772206 | B1 | 8/2017 |
| KR | 101937820 | B1 | 1/2019 |
| WO | 2015056989 | A1 | 4/2015 |
| WO | 2018088745 | A1 | 5/2018 |
| WO | 2018171600 | A1 | 9/2018 |

OTHER PUBLICATIONS

Supplementary European Search Report in the European application No. 19213730.5, dated Jun. 17, 2020.

International Search Report in the international application No. PCT/CN2019/110901, dated Feb. 26, 2020.

Second Office Action of the Korean application No. 10-2019-7033987, dated Mar. 18, 2021.

First Office Action of the Chinese application No. 201910493480.2, dated Mar. 5, 2021.

Second Office Action of the Korean application No. 10-2019-7033984, dated Mar. 18, 2021.

First Office Action of the Chinese application No. 201910493481.7, dated Mar. 8, 2021.

Second Office Action of the Chinese application No. 201910493481.7, dated Aug. 24, 2021.

* cited by examiner

ANTENNA AND ELECTRONIC DEVICE

CROSS-REFERENCE TO RELATED APPLICATION

This application claims priority to Chinese patent application No. 201910493480.2 filed on Jun. 6, 2019, the disclosure of which is hereby incorporated by reference in its entirety.

BACKGROUND

At present, 5th-Generation (5G) mobile communication networks have seen rapid research and development. With a transmission speed hundreds of times faster than a 4th-generation mobile communication currently in wide use, 5G networks are set to increase communication rate of electronic devices greatly.

SUMMARY

Embodiments of the present disclosure generally relate to the technical field of terminals, and more specifically to an antenna structure and an electronic device.

According to a first aspect of embodiments of the present disclosure, an antenna structure is provided, which includes:

an antenna array and a radio frequency component; and a radio frequency transfer switch, wherein the radio frequency transfer switch is connected with the antenna array and the radio frequency component, a number of the antenna array connected with the radio frequency transfer switch is greater than a number of the radio frequency component connected with the radio frequency transfer switch, the radio frequency transfer switch is configured to switch a feed object of at least one radio frequency component connected with the radio frequency transfer switch, and the feed object is any antenna array connected with the radio frequency transfer switch.

According to a second aspect of embodiments of the present disclosure, an electronic device is provided, which includes the above antenna structure.

It is to be understood that both the foregoing general description and the following detailed description are exemplary and explanatory only and are not restrictive of the embodiments of the present disclosure.

BRIEF DESCRIPTION OF THE DRAWINGS

The accompanying drawings referred to in the specification are a part of this disclosure, and provide illustrative embodiments consistent with the disclosure and, together with the detailed description, serve to illustrate some embodiments of the disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

The terminology used in the present disclosure is for the purpose of describing specific embodiments only and is not intended to limit the present disclosure. As used in the description of the present disclosure and the appended claims, the singular forms "a/an," "said" and "the" are intended to include the plural form as well, unless the context clearly indicates otherwise. It is also to be understood that term "and/or" as used herein refers to and encompasses any and all possible combinations of one or more of the associated listed items.

It is to be understood that, although terms first, second, third and the like may be adopted to describe various information in the present disclosure, the information should not be limited to these terms. These terms are only adopted to distinguish the information of the same type. For example, without departing from the scope of the present disclosure, first information may also be called second information; similarly, second information may also be called first information. For example, term "if" used here may be explained as "while" or "when" or "responsive to determining/in response to determining," which depends on the context.

Based on rapid development of the 5G mobile communication networks, a requirement for an antenna structure in the electronic device also increases. For example, for meeting a communication requirement, multiple antenna arrays and radio frequency front ends in one-to-one correspondence with the multiple antenna arrays are usually arranged in the electronic device.

Figure 1:
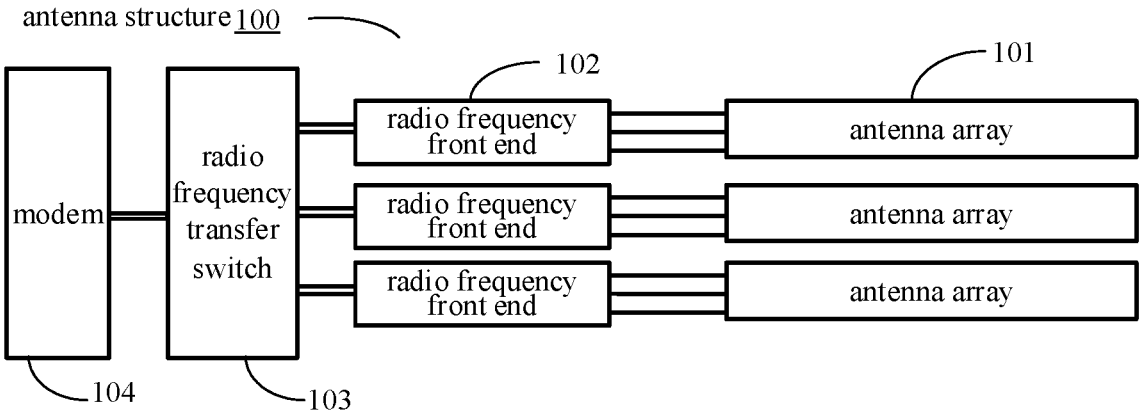
FIG. 1 (PRIOR ART)
FIG. 1 is a modular block diagram of an antenna structure of related art.

FIG. 1 is a modular block diagram of an antenna structure of related art. As illustrated in FIG. 1, in the related art, an antenna structure 100 can include multiple antenna arrays 101 and multiple radio frequency front ends 102. The multiple radio frequency front ends 102 are connected with/to the multiple antenna arrays 101 in one-to-one correspondence, and the multiple radio frequency front ends 102 are all connected to a radio frequency transfer switch 103, so that the radio frequency front end 102 is turned on by controlling the radio frequency transfer switch 103, and the corresponding antenna array 101 can be switched to a working state. The radio frequency transfer switch 103 can further be connected to a mainboard of an electronic device with the antenna structure 100 through a modem 104.

However, in the related art, since the corresponding radio frequency front end 102 is required to be carried/set for each antenna array 101, when the multiple antenna arrays 101 are required to be configured in the electronic device to meet a requirement for beam coverage, it is inevitable to increase the number of radio frequency front ends 102 and increase hardware cost.

Figure 2:
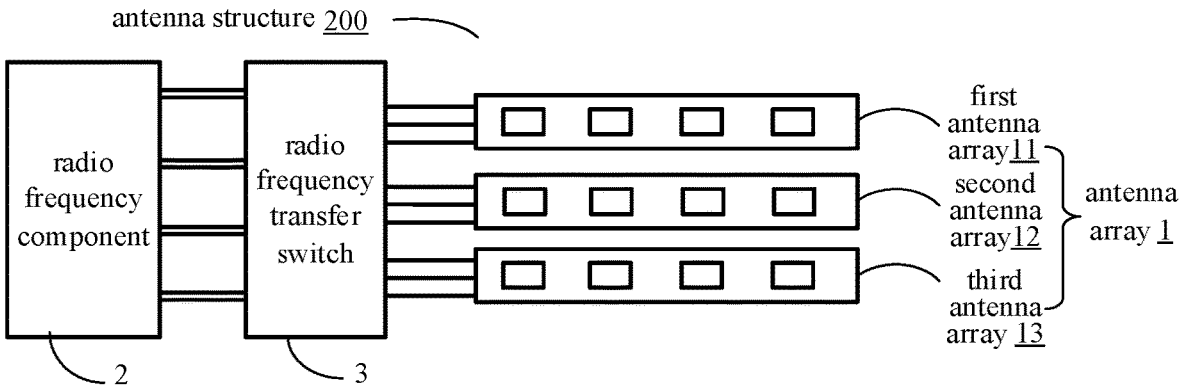
FIG. 2 is a modular block diagram of an antenna structure, according to some embodiments of the present disclosure.

Therefore, as illustrated in FIG. 2, an embodiment of the present disclosure provides an antenna structure 200. For/in the antenna structure 200, the number of required radio frequency component and production cost can be reduced.

Specifically, the antenna structure 200 can include an antenna array 1, a radio frequency component 2 and a radio frequency transfer switch 3. The radio frequency transfer switch 3 is connected with the antenna array 1 and the radio frequency component 2, and the number of the antenna array 1 connected with the radio frequency transfer switch 3 is greater than the number of the radio frequency component 2 connected with the same radio frequency transfer switch 3. For example, as illustrated in FIG. 2, assuming that the antenna array 1 can include a first antenna array 11, a second antenna array 12 and a third antenna array 13, all the first antenna array 11, the second antenna array 12 and the third antenna array 13 are connected with the radio frequency transfer switch 3, and the radio frequency component 2 is also connected with the radio frequency transfer switch 3. The number of the radio frequency component 2 connected with the radio frequency transfer switch 3 is one, and the number of the antenna array 1 connected with the same radio frequency transfer switch 3 is three. Based on this, a feed object of the single radio frequency component 2 can be switched/changed/toggled through the radio frequency transfer switch 3. The feed object can be any of the first antenna array 11, the second antenna array 12, or the third antenna array 13.

For example, as illustrated in FIG. 2, a radio frequency signal sent by/from the radio frequency component 2 can be sent to the first antenna array 11 through the radio frequency transfer switch 3, and the first antenna array 11 is turned into a working state; or, in another embodiment, a radio frequency signal sent from the radio frequency component 2 can be sent to the second antenna array 12 through the radio frequency transfer switch 3, and the second antenna array 12 is turned into the working state. Of course, in another embodiment, the other antenna array can also be switched into the working state through the radio frequency transfer switch 3, which will not be elaborated herein.

It can be seen from the abovementioned embodiment that the feed object of the radio frequency component 2 can be switched by using a switching function of the radio frequency transfer switch 3, so that it can still be ensured that each antenna array can be connected with the radio frequency component 2 under the circumstance that the number of the radio frequency component 2 is less than that of the antenna array 1. Comparing with the related art, the number of required radio frequency component 2 in/of the antenna structure 200 and the production cost can be reduced.

It is to be noted that, taking the embodiment illustrated in FIG. 2 for example, the antenna structure 200 includes three antenna arrays and all the three antenna arrays are connected with the radio frequency transfer switch 3. In another embodiment, the antenna structure 200 can also include two, four or five antenna arrays, and one or more antenna arrays can be directly connected with the corresponding radio frequency component. There are no limits made in the embodiment of the present disclosure. The radio frequency component 2 can include one or more of an amplifier, a filter, or a frequency converter. There are no limits made in the embodiment of the present disclosure. Based on the abovementioned embodiments, the number of the radio frequency component 2 can also be one or more, which will be described below in detail.

In some embodiments, as illustrated in FIG. 2, the antenna structure 200 can include a single radio frequency component 2, a first antenna array 11, a second antenna array 12 and a third antenna array 13. All the first antenna array 11, the second antenna array 12 and the third antenna array 13 are connected with the radio frequency transfer switch 3, and the single radio frequency component 2 is also connected with the radio frequency transfer switch 3, so that a feed object of the single radio frequency component 2 is switched through the radio frequency transfer switch 3.

As illustrated in FIG. 2, the single radio frequency component 2 can include multiple feed ports, each antenna array can include multiple antenna elements, and the numbers of the multiple antenna elements and the multiple feed ports are equal. For example, as illustrated in FIG. 2, each antenna array can include four antenna elements, and the radio frequency component 2 can include four feed ports, so that it can be ensured that radio frequency signals from the radio frequency component 2 is sent to the corresponding antenna elements one by one. Of course, in another embodiment, there can exist, for example, 3, 5, 6 or a good number of antenna elements in each antenna array. There are no limits made in the embodiment of the present disclosure.

Figure 3:
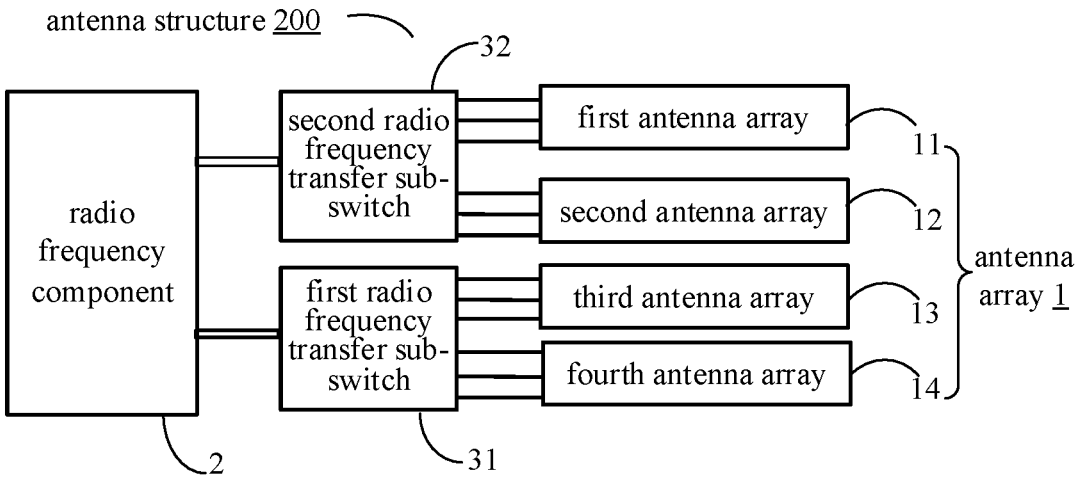
FIG. 3 is a modular block diagram of another antenna structure, according to some embodiments of the present disclosure.

In the embodiments, the antenna structure 200 illustrated in FIG. 2 can include a single radio frequency transfer switch 3; or, in another embodiment, as illustrated in FIG. 3, the radio frequency transfer switch 3 can also include multiple radio frequency transfer sub-switches. Each feed port of the single radio frequency component 2 is connected with a radio frequency transfer sub-switch, and each radio frequency transfer sub-switch is connected with at least one antenna array, so that a feed object of the feed port is regulated through the radio frequency sub-switch.

For example, as illustrated in FIG. 3, the radio frequency transfer switch 3 can include a first radio frequency transfer sub-switch 31 and a second radio frequency transfer sub-switch 32. The single radio frequency component 2 can include a first feed port connected with the first radio frequency transfer sub-switch 31 and a second feed port connected with the second radio frequency transfer sub-switch 32. The antenna structure 200 can include a first antenna array 11, a second antenna array 12, a third antenna array 13 and a fourth antenna array 14. The first antenna array 11 and the second antenna array 12 are connected with the second radio frequency transfer sub-switch 32, and the third antenna array 13 and the fourth antenna array 14 are connected with the first radio frequency transfer sub-switch 31. Based on this, the first feed port can be connected with the third antenna array 13 or the fourth antenna array 14 through the first radio frequency transfer sub-switch 31, and the second feed port can be connected with the first antenna array 11 or the second antenna array 12 through the second radio frequency transfer sub-switch 32. Of course, descriptions are made herein with the condition that the antenna structure 200 includes two radio frequency transfer switches as an example. In another embodiment, three, four or five radio frequency transfer switches can also be included, of course. There are no limits made in the embodiment of the present disclosure.

In contrast to the embodiments that the antenna structure 200 includes the single radio frequency component, the antenna structure 200 in another embodiment of the present disclosure can also include multiple radio frequency components as follows.

Figure 4:
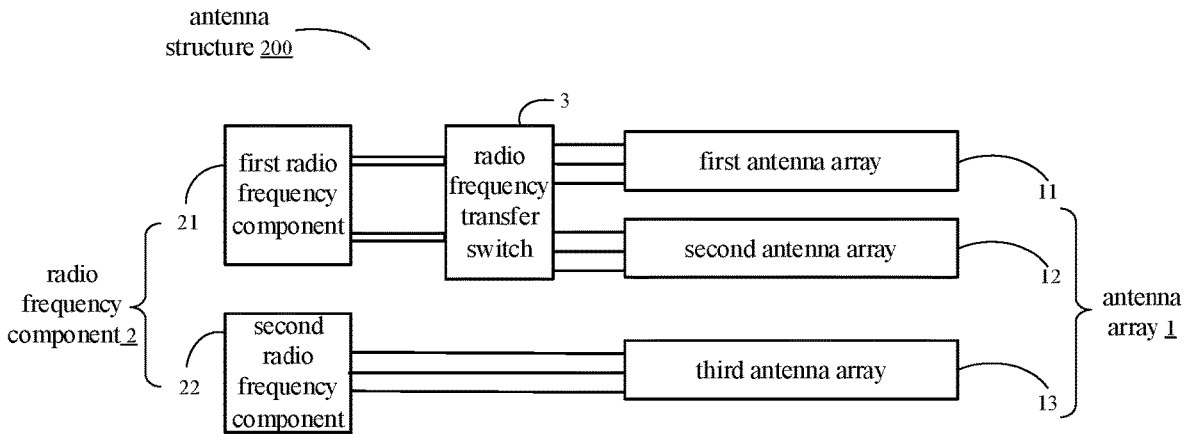
FIG. 4 is a modular block diagram of another antenna structure, according to some embodiments of the present disclosure.

In some embodiments, as illustrated in FIG. 4, the antenna structure 200 can include multiple radio frequency components, and at least one of the multiple radio frequency components can select an antenna array of at least two antenna arrays for feeding through the radio frequency transfer switch 3. For example, as illustrated in FIG. 4, the multiple radio frequency components 2 can include a first radio frequency component 21 and a second radio frequency component 22, and multiple antenna arrays can include a first antenna array 11, a second antenna array 12 and a third antenna array 13. The first radio frequency component 21 is connected with the radio frequency transfer switch 3, and the first antenna array 11 and the second antenna array 12 are connected with the radio frequency transfer switch 3, so that the first radio frequency component 21 can be connected with the first antenna array 11 or the second antenna array 12 through the radio frequency transfer switch 3, and the second radio frequency component 22 can be connected with the third antenna array 13.

The antenna structure 200 can only include a single radio frequency transfer switch, and the single radio frequency transfer switch can be connected with each radio frequency component and each antenna array. As illustrated in FIG. 4, the single radio frequency transfer switch 3 is connected with the first radio frequency component 21.

Figure 5:
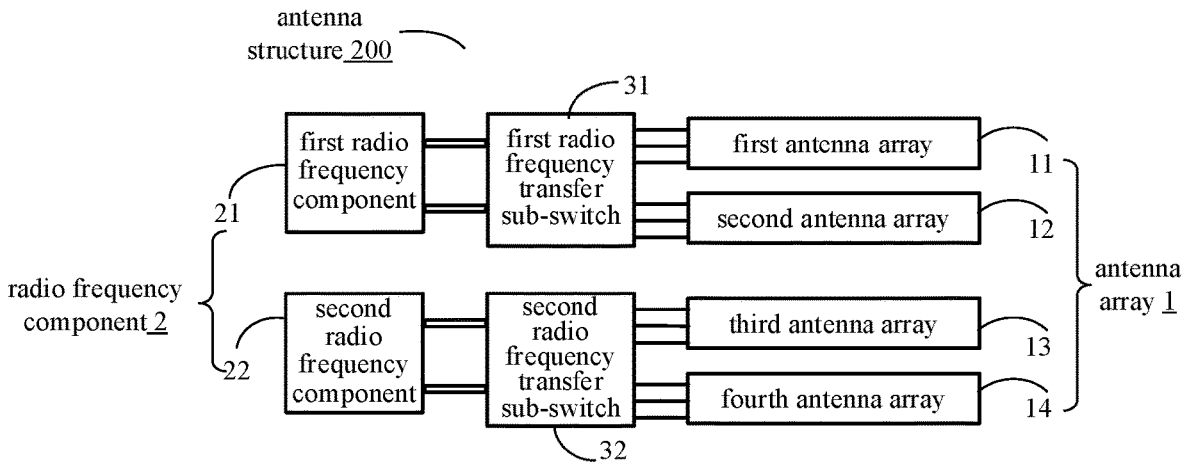
FIG. 5 is a modular block diagram of another antenna structure, according to some embodiments of the present disclosure.

In another embodiment, as illustrated in FIG. 5, the radio frequency transfer switch 3 can include multiple radio frequency transfer sub-switches in one-to-one correspondence with the multiple radio frequency components. For example, as illustrated in FIG. 5, the multiple radio frequency transfer switches 3 can include a first radio frequency transfer sub-switch 31 and a second radio frequency transfer sub-switch 32, multiple radio frequency components 2 can include a first radio frequency component 21 and a second radio frequency component 22, and multiple antenna arrays 1 can include a first antenna array 11, a second antenna array 12, a third antenna array 13 and a fourth antenna array 14. The first radio frequency component 21 is connected with the first radio frequency transfer sub-switch 31, and the first radio frequency transfer sub-switch 31 is also connected with the first antenna array 11 and the second antenna array 12, so that a feed object of the first radio frequency component 21 can be switched through the first radio frequency transfer sub-switch 31. The second radio frequency component 22 is connected with the second radio frequency transfer sub-switch 32, and the second radio frequency transfer sub-switch 32 is also connected with the third antenna array 13 and the fourth antenna array 14, so that a feed object of the second radio frequency component 22 can be switched through the second radio frequency transfer sub-switch 32.

Based on each abovementioned embodiment, the multiple antenna arrays of/in the antenna structure 200 can be arranged in parallel, which is favorable for saving an internal space of the electronic device configured with the antenna structure 200. The antenna structure 200 can include a 5G millimeter wave antenna to enhance communication performance of the electronic device. The electronic device configured with the antenna structure 200 provided in the embodiments of the present disclosure can include a handheld terminal, for example, a mobile phone and a tablet computer; or the electronic device can also include a wearable device, for example, a smart watch; or the electronic device can also include a smart home device.

In embodiments of the present disclosure, a feed object of a radio frequency component can be switched through a switching function of a radio frequency transfer switch, so that it can still be ensured that each antenna array can be connected with the radio frequency component under the circumstance that the number of the radio frequency component is less than the number of the antenna array. Comparing with the related art, the number of required radio frequency component of an antenna structure and production cost can be reduced.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In some embodiments, the control and/or interface software or app can be provided in a form of a non-transitory computer-readable storage medium having instructions stored thereon is further provided. For example, the non-transitory computer-readable storage medium can be a ROM, a CD-ROM, a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a standalone program or as a portion, component, subroutine, object, or other portion suitable for use in a computing environment. A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode), or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombinations.

Moreover, although features can be described above as acting in certain combinations and even initially claimed as such, one or more features from a claimed combination can in some cases be excised from the combination, and the claimed combination can be directed to a subcombination or variations of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

In the description of the present disclosure, the terms "some embodiments," "example," or "some examples," and the like may indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described may be combined in a suitable manner in any one or more embodiments or examples. In addition, various embodiments or examples described in the specification, as well as features of various embodiments or examples, may be combined and reorganized.

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombinations.

Moreover, although features can be described above as acting in certain combinations and even initially claimed as such, one or more features from a claimed combination can in some cases be excised from the combination, and the claimed combination can be directed to a subcombination or variations of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

The invention claimed is:

1. An antenna structure, comprising:

at least one antenna array and at least one radio frequency component; and a radio frequency transfer switch, wherein:

an end of the radio frequency transfer switch is connected with the at least one antenna array, and another end of the radio frequency transfer switch is connected with the at least one radio frequency component;

a number of the at least one antenna array connected with the radio frequency transfer switch is greater than a number of the at least one radio frequency component connected with the radio frequency transfer switch;

the radio frequency transfer switch is configured to switch a feed object of the at least one radio frequency component connected with the radio frequency transfer switch;

the feed object is any antenna array connected with the radio frequency transfer switch; and the radio frequency transfer switch comprises multiple radio frequency transfer sub-switches.

2. The antenna structure of claim 1, comprising:

multiple antenna arrays, each antenna array is connected with the radio frequency transfer switch; and a single radio frequency component, the single radio frequency component is connected with the radio frequency transfer switch to switch a feed object of the single radio frequency component through the radio frequency transfer switch.

3. The antenna structure of claim 2, wherein each antenna array comprises multiple antenna elements, the single radio frequency component comprises multiple feed ports, and a number of the feed ports is equal to a number of the antenna elements.

4. The antenna structure of claim 2, wherein each feed port of the single radio frequency component is connected with a radio frequency transfer sub-switch respectively, and each radio frequency transfer sub-switch is connected with at least one antenna array.

5. The antenna structure of claim 1, comprising multiple radio frequency components, wherein at least one of the multiple radio frequency components is capable of selecting one of at least two antenna arrays for feeding through the radio frequency transfer switch.

6. The antenna structure of claim 5, wherein the multiple radio frequency transfer sub-switches are set in one-to-one correspondence with the multiple radio frequency components.

7. The antenna structure of claim 1, wherein the multiple antenna arrays are arranged in parallel.

8. The antenna structure of claim 1, comprising a 5th-Generation (5G) millimeter wave antenna.

9. A mobile phone comprising the antenna structure of claim 1, comprising a first number of antenna arrays and a second number of radio frequency component(s), wherein the first number is larger than the second number.

10. The mobile phone of claim 9, wherein the mobile phone is configured to switch the feed object of the radio frequency component through a switching function of the radio frequency transfer switch, to ensure that each antenna array is capable of being connected with the radio frequency component, thereby reducing the second number of required radio frequency component(s).

11. An electronic device, comprising an antenna structure including:

at least one antenna array and at least one radio frequency component; and a radio frequency transfer switch, wherein:

an end of the radio frequency transfer switch is connected with the at least one antenna array, and another end of the radio frequency transfer switch is connected with the at least one radio frequency component;

a number of the at least one antenna array connected with the radio frequency transfer switch is greater than a number of the at least one radio frequency component connected with the radio frequency transfer switch;

the radio frequency transfer switch is configured to switch a feed object of the at least one radio frequency component connected with the radio frequency transfer switch;

the feed object is any antenna array connected with the radio frequency transfer switch; and the radio frequency transfer switch comprises multiple radio frequency transfer sub-switches.

12. The electronic device of claim 11, comprising:

multiple antenna arrays, each antenna array is connected with the radio frequency transfer switch; and a single radio frequency component, the single radio frequency component is connected with the radio frequency transfer switch to switch a feed object of the single radio frequency component through the radio frequency transfer switch.

13. The electronic device of claim 12, wherein each antenna array comprises multiple antenna elements, the single radio frequency component comprises multiple feed ports, and a number of the feed ports is equal to a number of the antenna elements.

14. The electronic device of claim 12, wherein each feed port of the single radio frequency component is connected with a radio frequency transfer sub-switch respectively, and each radio frequency transfer sub-switch is connected with at least one antenna array.

15. The electronic device of claim 11, comprising multiple radio frequency components, wherein at least one of the multiple radio frequency components is capable of selecting one of at least two antenna arrays for feeding through the radio frequency transfer switch.

16. The electronic device of claim 15, wherein the multiple radio frequency transfer sub-switches are set in one-to-one correspondence with the multiple radio frequency components.

17. The electronic device of claim 11, wherein the multiple antenna arrays are arranged in parallel.

18. The electronic device of claim 11, further comprising a 5th-Generation (5G) millimeter wave antenna.

* * * * *